US006201348B1

(12) United States Patent
Nortrup et al.

(10) Patent No.: US 6,201,348 B1
(45) Date of Patent: Mar. 13, 2001

(54) CAPACITIVE COUPLING STARTING AID FOR METAL HALIDE LAMP

(75) Inventors: Edward H. Nortrup, Stoneham; Elliot F. Wyner, Peabody; Nanu Brates, Malden, all of MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/192,741

(22) Filed: Nov. 16, 1998

Related U.S. Application Data

(60) Provisional application No. 60/075,327, filed on Feb. 20, 1998.

(51) Int. Cl.[7] ..... H01J 17/20

(52) U.S. Cl. ..... 313/573; 313/574; 313/25; 313/631

(58) Field of Search ..... 313/568, 572, 313/573, 574, 601, 607, 25, 234, 331, 318.01

(56) References Cited

U.S. PATENT DOCUMENTS

| | | | | |
|---|---|---|---|---|
| 3,828,214 | | 8/1974 | Keeffe et al. | 313/1 |
| 3,900,753 | | 8/1975 | Richardson | 313/198 |
| 4,134,042 | * | 1/1979 | van HeemsKerck | 315/59 |
| 5,389,856 | * | 2/1995 | Luijks et al. | 315/58 |
| 5,708,328 | * | 1/1998 | Mathews et al. | 313/573 |
| 5,889,360 | * | 3/1999 | Frey et al. | 313/318.01 |

* cited by examiner

*Primary Examiner*—Nimeshkumar D. Patel
*Assistant Examiner*—Karabi Guharay
(74) *Attorney, Agent, or Firm*—William H. McNeill

(57) ABSTRACT

A starting aid for a metal halide discharge lamp. An arc discharge tube is positioned in a hermetically sealed jacket. The jacket contains a partial pressure (e.g., 400 torr nitrogen) of a gas that will aid in starting the discharge and one of the arc tube lead-ins has an electrical conductor affixed thereto and exposed to the partial pressure of the gas. An outer conductor extends on the outside of the jacket and is electrically connected to the other lead-in. When voltage is applied to the electrodes a capacitive coupling takes place between the inner conductor and the outer conductor which generates a discharge that causes a breakdown in the arc generating and sustaining medium within the arc tube and causes the lamp to start.

7 Claims, 3 Drawing Sheets

CAPACITIVE COUPLING STARTING AID FOR METAL HALIDE LAMP

This application claims the benefit of U.S. Provisional Application No. 60/075,327 filed Feb. 20, 1998.

FIELD OF THE INVENTION

This invention relates to starting aids and more particularly to starting aids for high intensity discharge (HID) lamps and, still more particularly, to starting aids incorporated in an aluminosilicate outer jacket.

BACKGROUND OF THE INVENTION

HID lamps require a ballast in the electric circuit with the lamp in order to operate. The ballast supplies the requisite open circuit voltage to start and maintain an arc in the discharge tube as well as limiting the current therethrough. One style of ballast uses a high voltage pulse to initiate breakdown in the arc discharge tube. Arc tube breakdown is the first phase of lamp starting and is, therefore, essential for lamp operation. The typical high voltage pulse for a ballast of this type has an amplitude between 3.0 and 4.0 kilovolts with a width of 1.0 $\mu$s at 2.7 kilovolts. The maximum voltage can be increased; however, such an action requires a more expensive base on the lamp and a more expensive socket in the fixture.

There are two commercial ballast methods of applying the typical voltage to the lamp. The first method applies the pulse voltage to the center contact of the lamp base. The second method divides the pulse between the center contact and the shell of the base. The second method, referred to as the split lead design, has the unusual characteristic of floating the lamp lead wires such that both lamp lead wires carry pulse voltage with respect to ground. When the pulse voltage is applied to the lamp, 1.7 kv is applied to the center contact and an opposite potential of approximately equal magnitude is applied to the shell of the lamp.

With the typical high voltage pulse, the HID lamp requires a starting aid to initiate instantaneous breakdown. There are several known aids to reduce the pulse requirements and to make less expensive systems. One such aid adds radioactive krypton 85 to the argon gas contained in the arc tube. Another method is to lower the arc tube buffer gas pressure. Still another employed technique adds a glow bottle that produces ultraviolet light adjacent the arc tube (see U.S. Pat. No. 4,818,915). Yet another technique adds a bubble containing gas to the arc tube seal. This technique also produces ultraviolet light in the area of the arc tube. (See, U.S. Pat. No. 5,323,091 and Ser. No. 08/372,069).

While each of these techniques is workable, they all have some disadvantages. The use of krypton 85 has the attendant difficulties of handling radioactive materials such as gas reclaiming systems and the cost of state and federal licenses.

The use of glow bottles is not advantageous because the glow bottle would have to be inside the aluminosilicate jacket and there simply is not enough room. Positioning outside of the jacket is not workable since the aluminosilicate jacket does not pass UV radiation.

The bubble-in-the-press approach requires extra molybdenum foils to penetrate the bubble. This is difficult to accomplish in the smaller size arc tubes and adds material cost as well as assembly cost. Further, this technique is not workable with a split lead ballast since the voltage applied to the bubble electrode would only be 1.7 kv with respect to the isolated frame and the bubble gas would not breakdown.

DISCLOSURE OF THE INVENTION

It is, therefore, an object of the invention to obviate the disadvantages of the prior art.

It is another object of the invention to provide an improved arc tube assembly with improved starting.

It is another object of this invention to provide a new arc tube assembly that enhances starting.

It is a further object of this invention to provide a new arc tube assembly that is well suited for a reflector lamp.

These objects are accomplished, in one aspect of the invention, by an arc tube assembly for a high intensity discharge lamp, which assembly comprises an arc tube having an arc chamber, oppositely disposed press seals at the ends of the arc chamber, and an electrode and an electrode lead-in sealed into each of the press seals, the electrodes terminating in the arc chamber and the lead-ins terminating externally of the press seals. An arc generating and sustaining medium is contained in the arc chamber and an hermetically sealed jacket containing a partial pressure of a gas that will support lamp starting surrounds the arc tube. The arc tube lead-ins extend beyond the jacket whereby electrical connections are made thereto. A first electrically conductive member is affixed to one of the lead-ins within the jacket and outside of the arc tube, and a second electrically conductive member is affixed to the other of the lead-ins and extends outside of the jacket. A capacitive coupling thus is formed between the first electrically conductive member and the second electrically conductive member that forms the starting aid.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
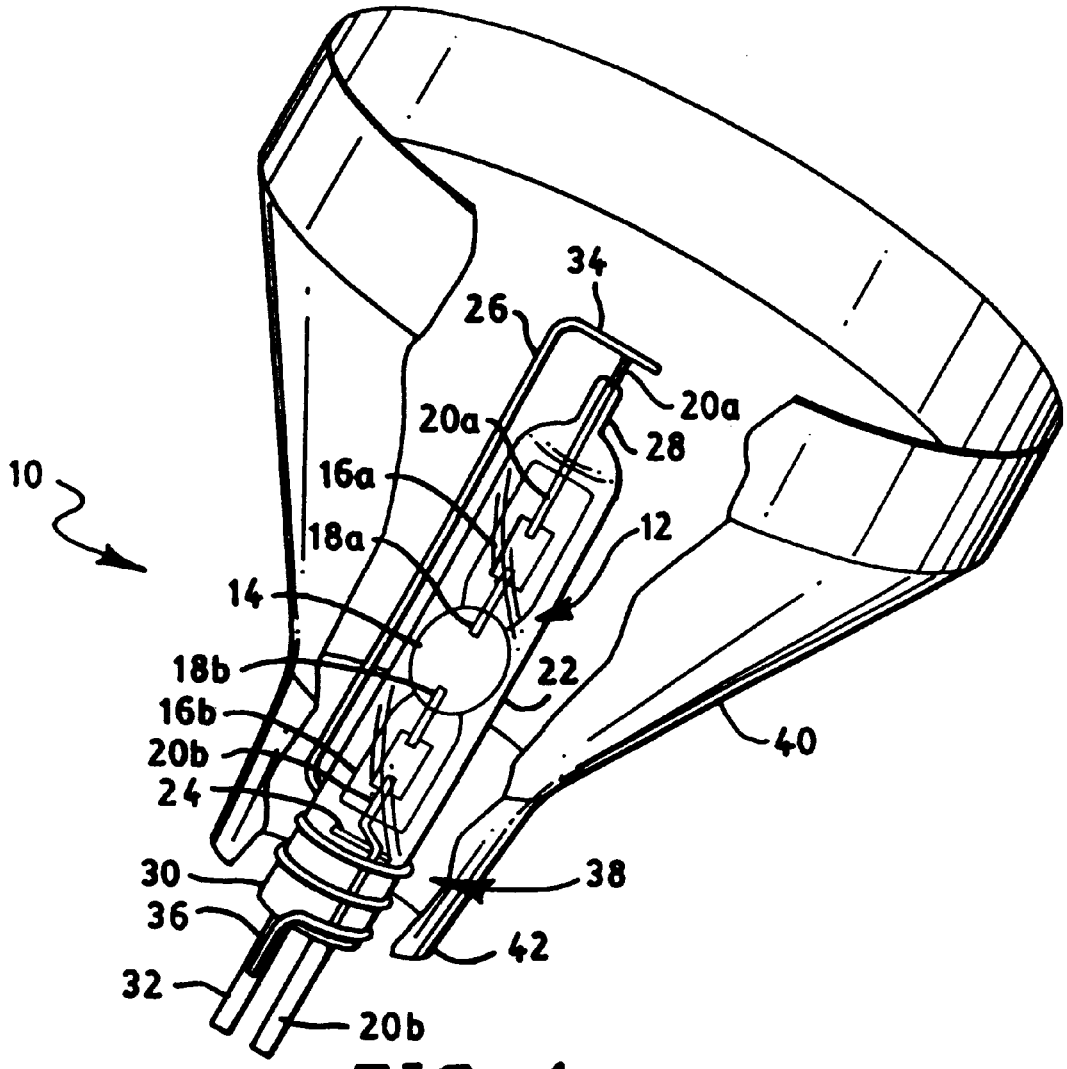
FIG. 1 illustrates a perspective, cut-away view of a reflector lamp employing the arc tube assembly of the invention.
Figure 3:
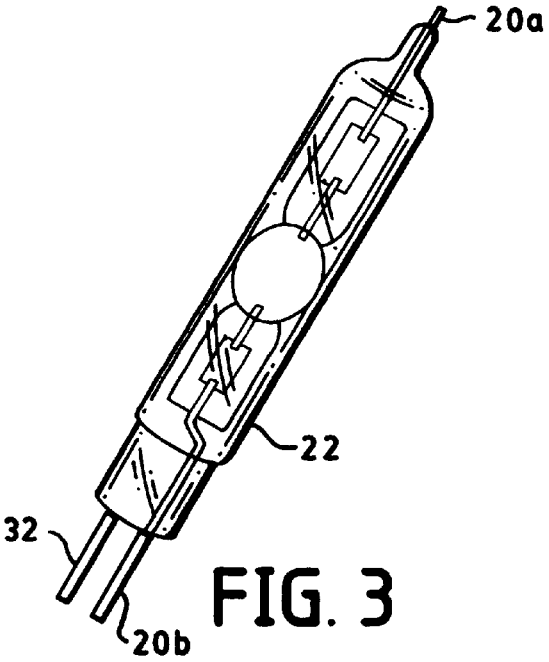
FIG. 3 shows the arc tube assembly illustrated in FIG. 1.
Figure 2:
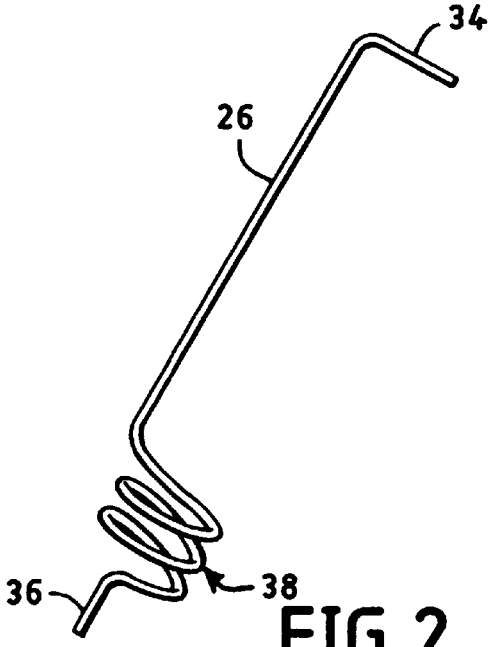
FIG. 2 depicts a spiral mount useable with this invention.

Referring to FIG. 1, an arc tube assembly 10 is illustrated. The arc tube assembly 10 comprises and arc tube 12 having an arc chamber 14 and oppositely disposed press seals 16*a*, 16*b* at the ends of the arc chamber 14. An electrode 18*a* is sealed into press seal 16*a* and terminates in the arc chamber 14. An electrode lead-in 20*a* terminates externally of the press seal 16*a*. The electrode and electrode lead-in are connected within the seal by a molybdenum foil, as is known in the art. The press seal 16*b* is similarly provided with an electrode 18*b* and an electrode lead-in 20*b*, the latter terminating exteriorly of the press seal 16*b*. An arc generating and sustaining medium, as is known in the art, is provided within the arc chamber 14. An hermetically sealed jacket 22 formed from a borosilicate or aluminosilicate glass, with the latter being preferred, surrounds the arc tube 12. The jacket contains a partial pressure of a gas that will support lamp starting. Preferably, the gas is nitrogen at a pressure of about 400 torr. The electrode lead-ins 20*a* and 20*b* extend beyond jacket 22 so that electrical connection can be made thereto.

An electrically conductive member 24, preferably constructed from molybdenum wire and having a diameter of 0.018 inches, is affixed to the electrode lead-in 20*b* at a position that is within the jacket 22 but outside the arc tube 14. A second electrically conductive member 26 is positioned outside of jacket 22 and has a first end 34 connected to the lead-in 20*a* at an upper portion 28 of jacket 22. The second end 36 is electrically connected to a dummy lead 32 sealed into the base 30 of jacket 22. Preferably, the second electrically conductive member 26, at a position adjacent the second end 36, is formed as a helix 38 which surrounds the base 30. The helix as shown contains three turns. In a preferred embodiment of the invention, the second electrically conductive member is formed from stainless steel wire having a diameter of 0.050 inches.

Figure 4:
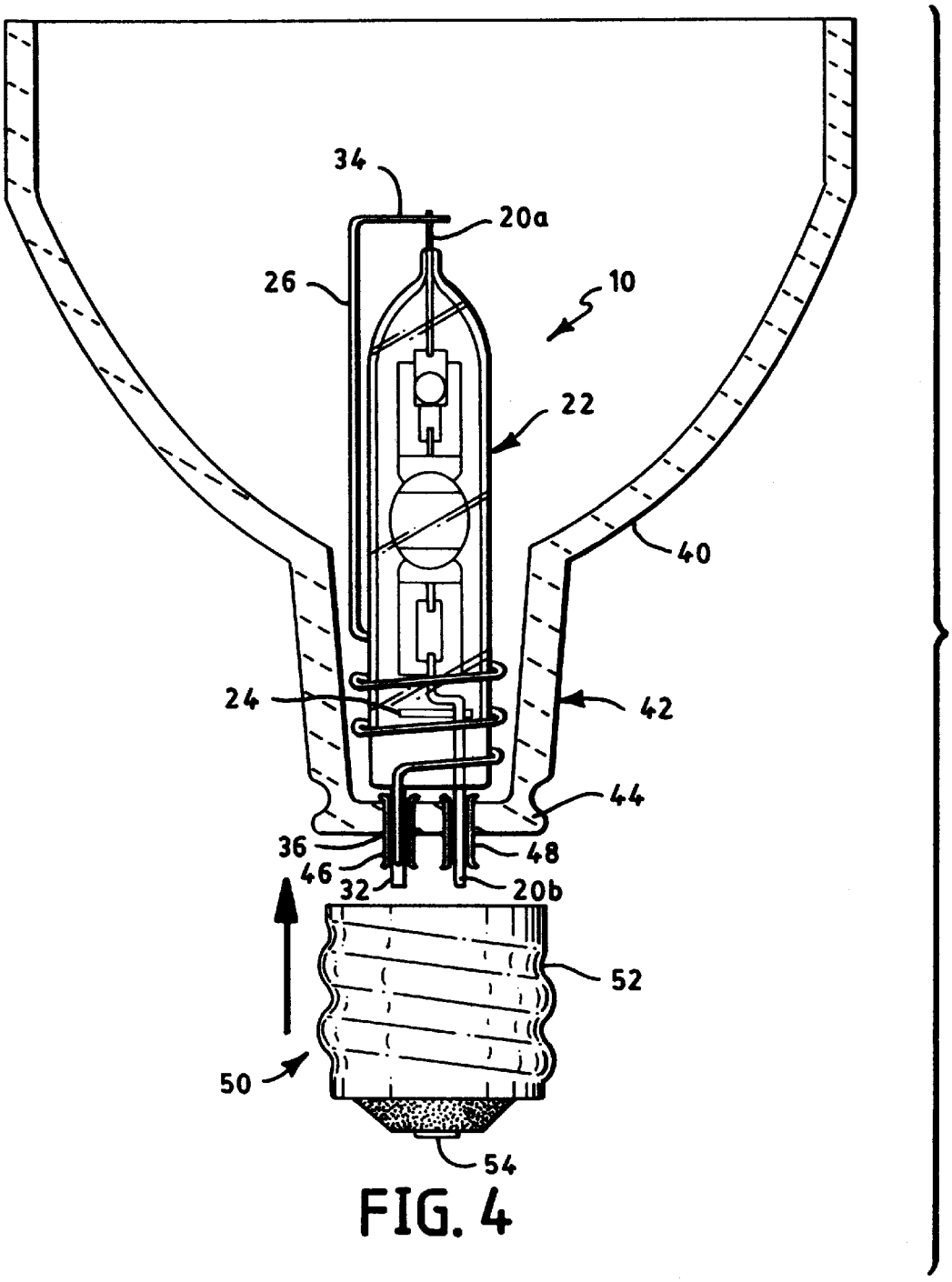
FIG. 4 is a sectional, elevational view of a lamp of the invention.

The assembly 10 is ideally suited for use in a PAR lamp, such as a PAR 30, and such a lamp is shown in FIGS. 1 and 4. The lamp comprises a parabolic envelope 40 having a neck 42 with a closed bottom 44 (see particularly, FIG. 4). Eyelets 46, 48 are sealed into the bottom 44 and receive the lead-ins 20*b* and 32. A lamp shell 50 is fixed to the bottom 44. One of the lead-ins, for example 32, is electrically connected to the side wall 52 and the other, for example 20*b*, is electrically connected to the center contact 54. When used with the split lead ballast described above, 1.7 kv is applied to the center contact 54 and an opposite potential of approximately equal magnitude is applied to the side wall 52.

For testing purposes, lamps of the above-described construction were compared to controls without the starting aid; that is, without the molybdenum wire 24 and without the nitrogen partial pressure inside the jacket 22. These tests showed that the control lamps without the starting aid were unacceptable 30% of the time while there were no failures in the lamps with the starting aid. Failure was defined as the inability of the lamp to start within 30 seconds. The distribution of starting times is typically not normal and Weibull distribution seems to yield the best prediction of starting probabilities. Using a Weibull model and 30 seconds as the upper specification limit, the Cpu (capability of starting under the upper specification limit) was 0.05 for the control group and 92.24 for the lamps with the starting aid.

The lamps were also tested in a hot-restrike mode. The time it took the lamp to start after being de-energized and re-energized was measured. The control group took approximately 8.3 minutes to restart while the lamps with the starting aids took only 4.4 minutes.

The majority of the lamp testing was conducted using a ballast that employed the split lead design. This ballast provided a typical pulse voltage of 3.4 kv between the lamp lead wires attached to the lamp. Similar lamp starting experiments were also performed on conventional ballasts where the pulse voltage was applied only to the center contact. These starting tests also showed instantaneous starting of the lamps with the starting aids while the control group suffered from long starting times.

While the outer wire used in the lamp design does not need to be helical, the best results are obtained when the helix is employed and the wire 24 is even with the center of the helix, as is shown in FIG. 4. The capacitive discharge achieved greatly improves lamp starting times. The outer wire or conductor 26 can be connected to the opposite potential from the ballast as the inner wire; however, this is not required. If the outer wire 26 is not attached to the opposite potential from the inner wire, the high voltage pulse from the ballast needs to have sufficient energy applied to the inner wire 24, as compared to the outer wire 26, to initiate a discharge. The outer wire 26 also needs to be in close proximity to the inner wire 24 such that there is adequate coupling and a discharge is produced. The inner wire 24 can take many different shapes and still be equally effective. For example, member 24 can be a foil or tab or it can be merely a bend in the lead-in 20*b* that extends close to the inside surface of jacket 22. All that is required is that an electric field be produced so that there is adequate coupling to the outer conductor 26 to produce a discharge in the inner jacket 22.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc tube assembly for a high intensity discharge lamp, said assembly comprising: an arc tube having an arc chamber, oppositely disposed press seals at the ends of said arc chamber, an electrode and an electrode lead-in sealed into each of said press seals, said electrodes terminating in said arc chamber and said lead-ins terminating externally of said press seal, and an arc generating and sustaining medium in said arc chamber; and an hermetically sealed jacket containing a partial pressure of a gas that will support lamp starting surrounding said arc tube, said arc tube lead-ins extending beyond said jacket whereby electrical connection can be made thereto; a first electrically conductive member affixed to one of said lead-ins within said jacket and outside of said arc tube; and a second electrically conductive member affixed to the other of said lead-ins and extending outside of said jacket, whereby a capacitive coupling is formed between said first electrically conductive member and said second electrically conductive member, said jacket has an upper portion through which projects a first of said arc tube lead-ins and a base through which projects a second of said arc tube lead-ins, said base containing additionally a dummy lead-in, said first electrically conductive member being electrically connected to said second of said arc tube lead-ins and said second electrically conductive member having a first end connected to said first of said arc tube lead-ins and a second end connected to said dummy lead-in.

2. The arc tube assembly of claim 1 wherein said gas is nitrogen.

3. The arc tube assembly of claim 2 wherein said partial pressure is about 400 torr.

4. The arc tube assembly of claim 3 wherein said second electrically conductive member has the end adjacent said base helically formed.

5. The arc tube assembly of claim 4 wherein said second electrically conductive member is stainless steel.

6. The arc tube assembly of claim 5 wherein said helical portion comprises three turns.

7. The arc tube assembly of claim 6 wherein said first electrically conductive member is a molybdenum wire.

* * * * *